US007935468B2

(12) United States Patent
Yamamoto et al.

(10) Patent No.: US 7,935,468 B2
(45) Date of Patent: May 3, 2011

(54) TONER AND METHOD OF MANUFACTURING THE SAME

(75) Inventors: Yoshinori Yamamoto, Yamatokoriyama (JP); Satoshi Ogawa, Nara (JP); Masao Suzuki, Tochigi (JP); Yoshiaki Akazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 979 days.

(21) Appl. No.: 11/812,364

(22) Filed: Jun. 18, 2007

(65) Prior Publication Data

US 2008/0057429 A1 Mar. 6, 2008

(30) Foreign Application Priority Data

Jun. 16, 2006 (JP) ..... 2006-168127

(51) Int. Cl.
*G03G 9/08* (2006.01)

(52) U.S. Cl. ..... 430/108.1; 430/111.41; 430/110.4

(58) Field of Classification Search ..... 430/111.41, 430/108.1, 108.4, 137.18, 123.5, 110.4
See application file for complete search history.

(56) References Cited

U.S. PATENT DOCUMENTS

| | | | | |
|---|---|---|---|---|
| 5,232,806 | A * | 8/1993 | Yamada et al. | 430/108.6 |
| 5,272,034 | A | 12/1993 | Kawano et al. | |
| 6,479,204 | B1 * | 11/2002 | Uchinokura et al. | 430/108.23 |

FOREIGN PATENT DOCUMENTS

| | | | |
|---|---|---|---|
| JP | 62-063941 | | 3/1987 |
| JP | 05-27483 | | 2/1993 |
| JP | 10246987 | A * | 9/1998 |
| JP | 11-338192 | | 12/1999 |
| JP | 2002-287429 | | 10/2002 |

OTHER PUBLICATIONS

English language machine translation of JP 10-246987 (Sep. 1998).*

* cited by examiner

*Primary Examiner* — Christopher RoDee
(74) *Attorney, Agent, or Firm* — Nixon & Vanderhye P.C.

(57) ABSTRACT

There is provided a toner which is excellent in temporal stability and environmental stability of charges and which is capable of forming images that contains almost no background fog and has high density even in a long-term use and in use at a high-temperature and high-humid circumstance, and furthermore the toner which is not scattered inside an image forming apparatus and thus causes no contamination inside the apparatus, and there is further provided a method of manufacturing the above toner. An organic boron compound is contained as a charge control agent, a surface CCA concentration per specific surface area of toner falls in a range from $2.1\times10^{-6}$ g/cm$^2$ to $5.5\times10^{-6}$ g/cm$^2$, and a surface CCA concentration is $1.8\times10^{-3}$ g/g or more.

2 Claims, 1 Drawing Sheet

TONER AND METHOD OF MANUFACTURING THE SAME

CROSS-REFERENCE TO RELATED APPLICATION

This application claims priority under 35 U.S.C. §119(a) on Patent Application No. 2006-168127, which was filed on Jun. 16, 2006 in Japan, the contents of which are incorporated herein by reference in their entirety.

BACKGROUND OF THE INVENTION

1. Field of the Invention

The present invention relates to a toner and a method of manufacturing the same.

2. Description of the Related Art

Conventionally, an image forming apparatus employing an electrophotographic process, an electrostatic printing process, or the like process, has been widely applied to a copier, a printer, a facsimile machine, and the like machine. For example, an electrophotographic image forming apparatus forms an image onto a recording sheet as follows. By using a photoreceptor on which surface a photosensitive layer containing a photoconductive substance is formed for serving as an image carrier, an electrostatic latent image based on image information is formed on the photoreceptor through various image-forming processes. The electrostatic latent image is then developed to a visible image by use of developer containing a toner, which is supplied from a developer tank. And the visible image is transferred to a recording material such as paper, and is then heated and pressed against the recording material by a developing roller so that the visible image is fixed on the recording material.

In the image forming apparatus as described above, the toner is used for visualizing the electrostatic latent image formed on the image carrier. And a dry developing method using a toner generally includes a developing method which employs frictional electrification, such as a powder craft method, a cascade method, and a magnetic brush method. Among these methods, the magnetic brush method has been widely used because, in the method, the developing operation can be easily controlled and it is possible to obtain a high-quality recording image. The magnetic brush method is classified into two types: a one-component developing method in which only a toner containing a magnetic substance constitutes a magnetic brush for development; and a two-component developing method in which two-component developer containing a toner and magnetic particles called carrier constitutes a magnetic brush for development. In both of the methods, the development is performed in a manner that predetermined charges are imparted to the toner on the magnetic brush, and the toner is brought to an electrostatic latent image on a photoreceptor by the Coulomb's force. In the toner, colorant is dispersed in binder resin. The binder resin includes various types of synthetic resin which exhibit electricity-detecting characteristic and binding characteristic to a moderate degree, represented by styrene-based resin and polyester-based resin, for example. Examples of the colorant include carbon black, organic colorant, and inorganic colorant.

In the developing method employing frictional electrification, in order to form images of substantially constant quality without deterioration stably and for a long period of time, it is desired that the toner be charged up to an appropriate level immediately after the developer tank is replenished therewith and furthermore that in outputting images one after another for a long period of time, the toner do not have charges excessively accumulated or unnecessarily released even through continuing frictional agitation so that the charge amount fluctuates in a narrow range. Moreover, the toner is required to have charges thereof not fluctuating in various environments, particularly, even in a high humidity environment so that the charge amount is stable for a long period of time.

With the aim of obtaining a stable toner which exhibits a small change in charge amount in course of time, to the toner is commonly added a charge control agent such as a metal-containing azo dye, salicylic-acid metal complex, and quanternary ammonium salt. These charge control agents, however, do not have sufficient dispersibility into the binder resin, thus causing the charge amount of toner to remarkably fluctuate, with the result that an image thus obtained may be varied in quality.

In view of the conventional technical problems, diverse proposals have been made for enhancing the dispersibility of the charge control agent into the binder resin, the stability of charge amount of toner, and the like characteristics.

For example, Japanese Unexamined Patent Publication JP-A 11-338192 (1999) discloses a toner for electrostatic charge image which has specified structure and characteristics and contains a charge control agent having an excellent charging property. The above-stated charge control agent is excellent in durability and environmental stability and further excellent in transparency by virtue of its characteristics of having an acicular crystal and a faintly yellow color, thus being suitable for a color toner.

Further, Japanese Examined Patent Publication JP-B2 7-104620 (1995) discloses a negative electric charge exchange control agent which contains an organic boron compound composed of: an organic anionic component containing boron as a charge exchange control agent; and a cationic component having a molecular size smaller than that of the organic anionic component. However, in the above-stated JP-B2 7-104620, no shape or dispersed state of the charge exchange control agent is mentioned and moreover, sufficient environmental stability and temporal stability are not obtained.

Further, there is a known electrophotographic toner of conventional design in which a content of charge control dye per 1 g of toner, that is to say, a surface CCA concentration of charge control agent is $2.0\times10^{-3}$ g/g to $9.0\times10^{-3}$ g/g where the charge control agent is present on the surface of the toner. The electrophotographic toner of these types, however, involves a problem that a carrier is contaminated by a charge control agent which is dropped off from toner particles upon repeated use for a long period of time. Given the problem, Japanese Unexamined Patent Publication JP-A 5-27483 (1993) discloses an electrophotographic toner of which surface CCA concentration mentioned above falls in a range of $1.0\times10^{-3}$ g/g to $1.7\times10^{-3}$ g/g for solving the above problem. The electrophotographic toner of which surface CCA concentration falls in the above range is able to decrease the contamination of toner thanks to a smaller surface CCA concentration and thus a smaller amount of charge control agent dropped off from the surfaces of toner particles as compared to those of conventional design. However, JP-A 5-27483 contains no description about a particle distribution of toner. A large amount of small-diameter toner leads an increase in the amount of charge control agent which is exposed on the surface, and such a charge control agent will drop off upon a long-term printing occasion, thereby causing the charge amount to fluctuate and thus resulting in poor temporal stability of charges. Moreover, the environmental stability of charges also deteriorates since the charge control agent is high in ion conductivity and thus susceptible to moisture outside.

SUMMARY OF THE INVENTION

An object of the invention is to provide a toner which is excellent in temporal stability and environmental stability of charges and which is capable of forming images that contains almost no background fog and has high density even in a long-term use and in use at a high-temperature and high-humid circumstance, and furthermore the toner which is not scattered inside an image forming apparatus and thus causes no contamination inside the apparatus, and to provide a method of manufacturing the same.

Hereinbelow, an amount of charge control agent exposed on a surface of toner per specific surface area of toner will be referred to as a surface CCA concentration per specific surface area of toner, and an amount of charge control agent exposed on a surface of toner per 1 g of toner will be referred to as a surface CCA concentration. Note that CCA is abbreviation of "Charge Control Agent".

The invention provides a toner containing at least: binder resin; colorant; and an organic boron compound acting as a charge control agent, the toner of which surface CCA concentration per specific surface area of toner falls in a range from $2.1\times10^{-6}$ g/cm$^2$ to $5.5\times10^{-6}$ g/cm$^2$ and of which surface CCA concentration is $1.8\times10^{-3}$ g/g or more.

According to the invention, an organic boron compound which is excellent in charge controllability is used as a charge control agent and moreover, the surface CCA concentration per specific surface area of toner and the surface CCA concentration fall in the above ranges, with the result that the toner of the invention exhibits excellent temporal stability of charges and moreover excellent start-up characteristic and environmental stability of charges even with the surface CCA concentration in a range of $2.0\times10^{-3}$ g/g to $9.0\times10^{-3}$ g/g which used to lead poor temporal stability of charges in the case of the conventional toner. It is therefore possible to provide a toner which can form images having a high density with almost no background fog even in a long-term use and in use at a high-temperature and high-humid circumstance, and furthermore which is not scattered inside an image forming apparatus and thus causes no contamination inside the apparatus.

Further, in the invention, it is preferable that $D_{10v}$ and $D_{90v}$ satisfy the following formula (1) where $D_{10v}$ represents a particle diameter at 10% of cumulative volume counted from a large-diameter side in a cumulative volume distribution, and $D_{90v}$ represents a particle diameter at 90% of cumulative volume counted from the large-diameter side in the cumulative volume distribution:

$$0.415 \leqq (D_{10v}-D_{90v})/D_{10v} \leqq 0.475 \quad (1),$$

wherein $D_{50v}$ falls in a range of 5 μm to 8 μm where $D_{50v}$ represents a particle diameter at 50% of cumulative volume counted from the large-diameter side in the cumulative volume distribution, and wherein a content of toner particles each having a diameter of 5 μm or less is 15% by number to 35% by number.

According to the invention, the toner of the invention contains a relatively large amount of toner particles each having a diameter of 5 μm or less which cause a decrease of fluidity, and nevertheless has the above-described specific particle distribution, thus exhibiting favorable fluidity. Accordingly, when the toner of the invention is used, no toner is scattered inside the image forming apparatus so that image defects such as background fog and void are rarely generated, and almost no toner filming is caused and it is thus very easy to perform cleaning of the photoreceptor. Moreover, the excellent fluidity of the toner of the invention allows simplification of a toner supply mechanism and a cleaning mechanism for photoreceptor inside the image forming apparatus, thus contributing to reduction in size and cost of the apparatus. In addition, the toner of the invention exhibits excellent definition-enhancing effect and resolution-enhancing effect of the image and thus excellent image reproducibility (in particular, thin-line reproducibility) so that a high-quality image can be formed. Furthermore, the toner of the invention is adaptable enough for a current mainstream high-speed machine, and even when used in an image forming apparatus of which set service life has already expired, the fluidity, definition-enhancing effect, and resolution-enhancing effect of the toner are sufficient, thus causing no decrease of image quality.

Further, in the invention, it is preferable that a content of the colorant is 3 parts by weight to 10 parts by weight based on 100 parts by weight of the binder resin.

According to the invention, when the content of the colorant falls in the above range, an image having high density and very favorable quality can be formed with the toner of which various properties are not impaired, and furthermore consumption of toner can be reduced, resulting in contribution to reduction in cost.

Further, in the invention it is preferable that the toner is used for electrophotography.

The invention provides a method of manufacturing the toner, comprising:

a first-stage mixing step of mixing toner components including at least binder resin, colorant, and an organic boron compound acting as a charge control agent; and a second-stage mixing step of putting into a mixture obtained at the first-stage mixing step a fine toner which has been removed in another toner manufacturing process, and mixing an obtained mixture again.

According to the invention, the fine toner is mixed at the second-stage mixing step as described above, thereby resulting in a toner which has properties equal to those of a fine particle-reproduced product in terms of start-up characteristic, temporal stability, and environmental stability of charges.

Further, the above manufacturing method enables reproduction of the fine toner which has been removed in another toner manufacturing process, thus resulting in reduction in cost and enhancement in productivity.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
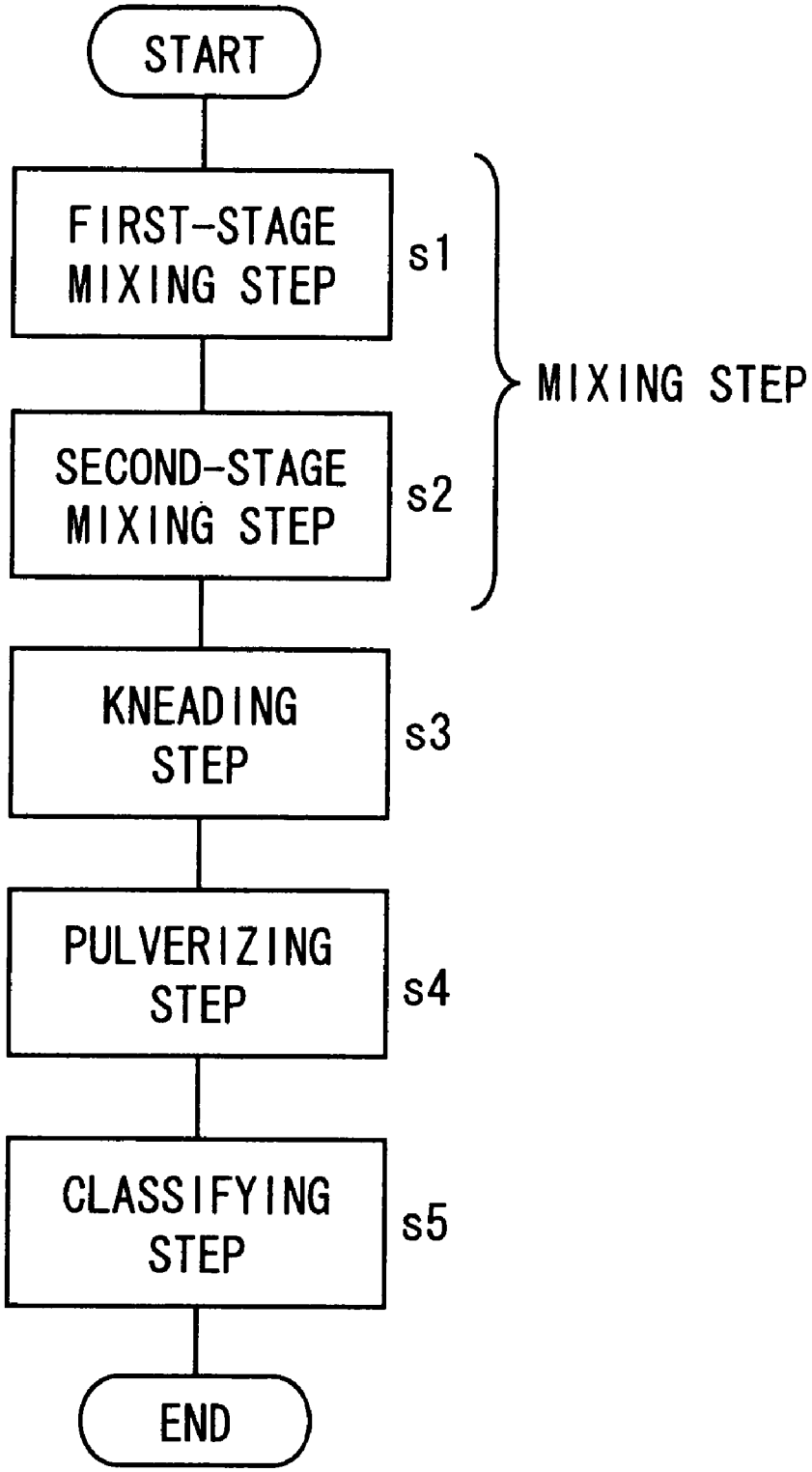
FIG. 1 is a flowchart for explaining a method of manufacturing a toner according to one embodiment of the invention.

Now referring to the drawings, preferred embodiments of the invention are described below.

A toner of the invention preferably contains at least: binder resin; colorant; and as a charge control agent, an organic boron compound. In the toner, it is preferred that a surface CCA concentration per specific surface area of toner fall in a range from $2.1\times10^{-6}$ g/cm$^2$ to $5.5\times10^{-6}$ g/cm$^2$ and a surface CCA concentration be $1.8\times10^{-3}$ g/g or more. The toner of the invention is preferably used for electrophotography.

Since the organic boron compound which is excellent in charge controllability is used as a charge control agent and since the surface CCA concentration per specific surface area of toner and the surface CCA concentration fall in the above ranges, the toner of the invention exhibits excellent temporal stability of charges and moreover excellent start-up characteristic and environmental stability of charges even with the surface CCA concentration in a range of $2.0\times10^{-3}$ g/g to $9.0\times10^{-3}$ g/g which used to lead poor temporal stability of charges in the case of the conventional toner. It is therefore possible to provide a toner which can form images having a high density with almost no background fog even upon a long-term use at a high-temperature and high-humid circumstance, and furthermore which is not scattered inside an image forming apparatus and thus causes no contamination inside the apparatus.

When the surface CCA concentration per specific surface area of toner is smaller than $2.1\times10^{-6}$ g/cm$^2$, the expected function of the charge control agent will not be sufficiently exhibited, and at a high-temperature and high-humid circumstance or at a low-temperature and low-humid circumstance, the start-up characteristic is so poor that the toner supplied does not swiftly retain charges, which easily causes the toner to be scattered, and furthermore the charge amount fluctuates in a wide range. In contrast, when the surface CCA concentration per specific surface area of toner is larger than $5.5\times10^{-6}$ g/cm$^2$, the charge control agent on the surfaces of toner particles will drop off upon a long-term printing occasion, thereby causing the charge amount to fluctuate. Furthermore, the above charge control agent is high in ion conductivity and thus susceptible to moisture outside at a high-humid circumstance.

Moreover, even when the surface CCA concentration per specific surface area of toner falls in a range of $2.1\times10^{-6}$ g/cm$^2$ to $5.5\times10^{-6}$ g/cm$^2$, the surface CCA concentration of less than $1.8\times10^{-3}$ g/g will lead a decrease of the charging property of toner itself, thus resulting in poor environmental stability of charges.

Further, the toner of the invention has a specific particle distribution indicated by the following (a) to (c).

The toner of the invention contains a relatively large amount of toner particles each having a diameter of 5 μm or less which cause a decrease of fluidity, and nevertheless has the specific particle distribution indicated by the following (a) to (c), thus exhibiting favorable fluidity. Accordingly, when the toner of the invention is used, no toner is scattered inside the image forming apparatus so that image defects such as background fog and void are rarely generated, and almost no toner filming is caused and it is thus very easy to perform cleaning of the photoreceptor. Moreover, the excellent fluidity of the toner of the invention allows simplification of a toner supply mechanism and a cleaning mechanism for photoreceptor inside the image forming apparatus, thus contributing to reduction in size and cost of the apparatus. In addition, the toner of the invention exhibits excellent definition-enhancing effect and resolution-enhancing effect of the image and thus excellent image reproducibility (in particular, thin-line reproducibility) so that a high-quality image can be formed. Furthermore, the toner of the invention is adaptable enough for a current mainstream high-speed machine, and even when used in an image forming apparatus of which set service life has already expired, the fluidity, definition-enhancing effect, and resolution-enhancing effect of the toner are sufficient, thus causing no decrease of image quality.

(a) the following formula (1) is satisfied:

$$0.415 \leqq (D_{10v}-D_{90v})/D_{10v} \leqq 0.475 \quad (1)$$

wherein $D_{10v}$ represents a particle diameter at 10% of cumulative volume counted from a large-diameter side in a cumulative volume distribution, and $D_{90v}$ represents a particle diameter at 90% of cumulative volume counted from the large-diameter side in the cumulative volume distribution.

When the value $(D_{10v}-D_{90v})/D_{10v}$ is smaller than 0.415, the particle distribution of nonmagnetic toner becomes very narrow and in manufacturing the toner, an operation for classification becomes complicated and the yield after the classification remarkably deteriorates, with the result that such a value is not practical for production of toner. When the value $(D_{10v}-D_{90v})/D_{10v}$ exceeds 0.475, the distribution of charge amount of toner becomes too broad, and there easily arise troubles such as the scattered toner inside the image forming apparatus and the background fog.

(b) $D_{50v}$ falls in a range of 5 μm to 8 μm wherein $D_{50v}$ represents a particle diameter at 50% of cumulative volume counted from the large-diameter side in the cumulative volume distribution.

When the particle diameter $D_{50v}$ is smaller than 5 μm, the toner has reduced fluidity and moreover is easily aggregated, thus being hard to be evenly mixed with a carrier within a short time, with the result that the number of insufficiently charged toner particles is increased. This causes the background fog to easily arise on a non-image part. Moreover, in this case, the charge amount per unit weight becomes excessively high, thus resulting in extremely decreased developing property. Furthermore, there arises a problem also from the aspect of manufacture that the decrease in yield at a crushing and classifying occasion leads an increase in cost. When the particle diameter $D_{50v}$ exceeds 8 μm, it becomes difficult to precisely reproduce dots in an electrostatic latent image, thus resulting in decreases in reproducibility, resolution, etc. of images. Further, in this case, graininess of the toner deteriorates, forming uneven images. Furthermore, the electrostatic latent image will easily have the toner more than necessary attached thereto, thus resulting in an increase of toner consumption.

(c) A content of toner particles each having a diameter of 5 μm or less is 15% by number to 35% by number.

When the content of such a toner is smaller than 15% by number, the reproducibility, resolution, etc. of images will be impaired, thus causing a resultant image to have deteriorated quality. In contrast, when the content of such a toner exceeds 35% by number, the distribution of charge amount of toner becomes broad, and there easily arise the background fog, defective cleaning of photoreceptor, and the like troubles, resulting in a decrease in a length of usable life. Further, in this case, the toner particles are liable to form an aggregate and therefore, such a toner aggregate having a diameter larger than the original particle diameter of toner causes image defects such as void in an image, thus leading a decrease in the resolution of the image.

In manufacturing the toner of the invention, known methods can be adopted and preferable is a grinding method in which it is relatively easy to disperse the charge control agent and other additives into the binder resin. FIG. 1 is a flowchart for explaining a method of manufacturing a toner according to one embodiment of the invention. In the grinding method, the toner of the invention can be manufactured in the following manner: the binder resin and the additives such as colorant, the charge control agent, and a release agent are premixed with each other homogeneously by a commonly-used mixer such as a dry-blender, a Henschel mixer, and a ball mill (mixing step: Step s1 and Step s2); a resultant mixture of raw materials is uniformly kneaded by a commonly-used kneading machine such as a twin-screw extruder and a single-screw extruder (kneading step: Step s3); a thus-obtained kneaded material is cooled to be solidified and then pulverized (pulverizing step: Step s4); and according to need, the kneaded material is classified (classifying step: Step s5).

For melting and kneading the mixture of raw materials in the above grinding method, it is preferable to use an open-roll kneading machine as a kneading machine. In the open-roll kneading machine, a nip width between two rolls which are arranged face-to-face is set to become gradually smaller from a supply side to a discharge side of the mixture of raw materials. By virtue of the gap thus formed, compression force given by the roll to the mixture of raw materials becomes larger from the supply side to the discharge side, thus resulting in an effect that the resultant kneaded material has favorable dispersibility of additives.

Further, the toner of the invention is manufactured by mixing, at a first-stage mixing step s1, toner components including at least binder resin, colorant, and an organic boron compound acting as a charge control agent, and then at a second-stage mixing step s2, putting into a mixture obtained at the first-stage mixing step s1 a fine toner which has been removed in another toner manufacturing process, and mixing an obtained mixture again, in order to reproduce the fine toner which has been removed in another toner manufacturing process. The fine toner has been removed at a classifying step, for example, in another toner manufacturing process.

As described above, the fine toner is mixed at a second-stage mixing step s2, thereby resulting in a toner which has properties equal to those of a fine particle-reproduced product in terms of start-up characteristic, temporal stability, and environmental stability of charges. Furthermore, the fine toner which has been removed in another toner manufacturing process can be reproduced, thus resulting in reduction in cost and enhancement in productivity.

Further, if the toner components and the fine toner are mixed at one time, the charge control agent will be insufficiently crushed at the first-stage mixing step s1, which leads deteriorated dispersibility of the charge control agent in the toner, thus causing a problem such as fluctuation of charge amount.

The particle diameter of the toner of the invention is not particularly limited, and an average particle diameter thereof is preferably 3 μm to 15 μm. In order to enhance the image quality so that a high-quality image is obtained, preferred is a small-diameter toner of which average particle diameter is 9 μm or less, and furthermore preferred is a small-diameter toner of which average particle diameter is 5 μm to 8 μm.

The toner of the invention contains binder resin, colorant, and a charge control agent. Other than the above ingredients, it is possible to add a release agent, an external additive, and the like ingredient to the toner of the invention. Components of the toner of the invention will be explained hereinbelow.

(Binder Resin)

The binder resin is not particularly limited, and it is possible to use known binder resin for black toner or for color toner. Examples of the known binder resin include: polyester resin; styrene resin such as polystyrene and styrene-acrylic acid ester copolymer resin; acrylic resin such as polymethyl methacrylate; polyolefin resin such as polyethylene; polyurethane; and epoxy resin. Further, it may also be possible to use resin which is obtained by mixing the release agent into the monomer mixture of raw materials, followed by polymerization reaction. The binder resin may be used each alone, or two or more of the binder resin may be used in combination.

(Charge Control Agent)

The charge control agent includes an organic boron compound composed of: an organic anionic component containing boron; and a cationic component having a molecular size smaller than that of the organic anionic component. Note that the molecular size in this case is represented by Stokes radius.

The organic anionic compound is represented by the following general formula (A), for example:

(A)

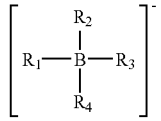

wherein $R_1$, $R_2$, $R_3$, and $R_4$ are organic groups which are independent from each other and may be the same, and moreover $R_1$ and $R_2$ may form a ring together with boron bonded thereto while $R_3$ and $R_4$ may form a ring together with boron bonded thereto.

Further, examples of the above cationic component include hydrogen cation, alkali metal cation, alkaline earth metal cation, zinc cation, cadmium cation, sulfonium cation, and phosphonium cation.

Presumably, polarities of charges of these organic boron compounds respectively depend on compositions or molecular sizes of boron-containing organic anionic component and cationic component, each of which constitutes a compound and takes advantage of electron acceptability of boron. In the invention, controllability on negative charges is expressed by using the cationic component of which molecular size is smaller than that of such an anionic component as described above containing boron of organic anionic component as a counter cation. Further, the organic boron compound contained in a developer composition of the invention often has no color or a light color and furthermore is excellent in charge controllability, therefore being used very favorably for controlling charges of black developer and other materials represented by color developer, which are incompatible with coloration.

A usage of the charge control agent in the toner of the invention is particularly limited, and preferably 0.5 part by weight to 3 parts by weight based on 100 parts by weight of the binder resin. The usage smaller than 0.5 part by weight may result in insufficient stability of charges given to the toner. In contrast, the usage exceeding 3 parts by weight may result in insufficient dispersion of the charge control agent into the binder resin and insufficient temporal stability of charges so that images having substantially constant high qualities cannot be stably obtained. Further, in this case, an amount of charge control agent present on a surface of toner is increased, which may lead defective charging at a high-humid circumstance and easily generate the background fog.

(Colorant)

As the colorant, it is possible to use ingredients which are customarily used in this field, including colorants for yellow toner, colorants for magenta toner, colorants for cyan tone, and colorants for black toner.

Examples of the colorants for yellow toner include azo pigments such as C.I. pigment yellow 1, C.I. pigment yellow 5, C.I. pigment yellow 12, C.I. pigment yellow 15, and C.I. pigment yellow 17; inorganic pigments such as yellow iron oxide and Chinese yellow; nitro dyes such as C.I. acid yellow 1; and oil-soluble dyes such as C.I. solvent yellow 2, C.I. solvent yellow 6, C.I. solvent yellow 14, C.I. solvent yellow 15, C.I. solvent yellow 19, and C.I. solvent yellow 21, as classified by Color Index.

Examples of the colorants for magenta toner include C.I. pigment red 49, C.I. pigment red 57, C.I. pigment red 81, C.I. pigment red 122, C.I. solvent red 19, C.I. solvent red 49, C.I. solvent red 52, C.I. basic red 10, and C.I. disperse red 15, as classified by Color Index.

Examples of the colorants for cyan toner include C.I. pigment blue 15, C.I. pigment blue 16, C.I. solvent blue 55, C.I. solvent blue 70, C.I. direct blue 25, and C.I. direct blue 86, as classified by Color Index.

Examples of the colorants for black toner include carbon black such as channel black, roller black, disc black, gas furnace black, oil furnace black, thermal black, and acetylene black. Among these various types of carbon black, suitable carbon black may be appropriately selected in accordance with the design characteristics of the toner to be obtained.

Apart from those pigments, also usable herein are other red pigments and green pigments. The colorants may be used each alone, or two or more of the colorants may be used in combination. Further, two or more colorants of the same color type may be combined, or one or more colorants of one color type may be combined with those of a different color type.

A usage of the colorant is not particularly limited, and preferably 3 parts by weight to 10 parts by weight based on 100 parts by weight of the binder resin. By using the colorant of which content falls in the above range, it is possible to form an image having high density and very favorable quality with the toner of which various properties are not impaired. Furthermore, in this case, the consumption of the toner is reduced, resulting in contribution to reduction in cost. When the usage of the colorant is less than 3 parts by weight, an increased amount of toner needs to be attached to an image in order to attain a high image density, thus causing an increase in toner consumption. When the usage of the colorant exceeds 10 parts by weight, a problem arises in color reproducibility.

(Release Agent)

As the release agent, it is possible to use ingredients which are customarily used in this field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of vinylic monomer and wax, and graft-modified derivatives of vinylic monomer and wax.

A usage of the wax may be appropriately selected from a wide range without particularly limitation, and preferably 0.2 part by weight to 20 parts by weight based on 100 parts by weight of the binder resin.

(External Additive)

Examples of the external additive include a fluidizing agent. The fluidizing agent is used for enhancing, for example, properties of toner appearing when conveyed, charged, and agitated with a carrier that may be contained together with the toner in a two-component developer. As the fluidizing agent, it is possible to use ingredients which are customarily used in this field, including, for example, inorganic fine particles such as aluminum oxide power, titanium oxide powder, and fine silica powder; organic fine particles such as vinylidene fluoride fine powder, polytetrafluoroethylene fine powder, fatty acid metal salt, zinc stearate, and calcium stearate; and materials obtained by applying the hydrophobilc treatment to the above ingredients. Among all the ingredients cited above, preferable are inorganic fine particles to which the hydrophobilc treatment has been applied. The fluidizing agents can be used each alone, and one or two or more of the fluidizing agents may be used in combination. A specific example of the combination of two or more of the fluidizing agents is a combination of one or two or more kinds of the inorganic fine particles to which the hydrophobic treatment has been applied, and one or two or more kinds of the organic fine particles.

A usage of the fluidizing agent may be appropriately selected from a wide range without particularly limitation, and preferably 0.1 part by weight to 3 parts by weight based on 100 parts by weight of the toner particles. The toner of the invention containing the fluidizing agent is obtained by mixing the toner particles and the fluidizing agent with each other by a commonly-used mixer so that the fluidizing agent is attached to surface of the toner particles, thereafter screening out aggregate and foreign substances.

The toner of the invention can be used in form of one-component developer and two-component developer. In the case where the toner of the invention is used in form of one-component developer, that is, used as a nonmagnetic toner, for example, the toner is charged by friction with a development sleeve using blade and fur brush so that the toner is attached onto the sleeve, and since the toner is conveyed by the sleeve onto which the toner is attached, the toner can be thus supplied to an electrostatic latent image on a surface of photoreceptor.

Further, in the case where the toner of the invention is used in form of two-component developer, a carrier is employed together with the toner of the invention. In this case, as the carrier, it is possible to use any carriers customarily used in this filed without particular limitation, and preferable is a resin-coated carrier which has a resin-coated layer on a carrier core material.

Examples of the carrier core material include magnetic metals such as iron, nickel, and cobalt; magnetic oxides such as ferrite and magnetite; and glass beads. A shape of core material is preferably spherical. Further, a particle diameter of core material is preferably 10 μm to 500 μm and more preferably 30 μm to 100 μm.

Examples of the resin for coating the carrier core material include polyethylene, polypropylene, polystyrene, polyacrylonitrile, polyvinyl acetate, polyvinyl butyral, polyvinyl chloride, polyvinyl carbazole, polyvinyl ether, polyvinyl ketone, a vinyl chloride-vinyl acetate copolymer, a styrene-acrylate copolymer, silicone resin having an organosiloxane bond, a denatured material of the silicone resin, fluorine resin, polyester, polyurethane, polycarbonate, phenol resin, amino resin, melamine resin, and benzoguanamine resin.

The resin cited above may contain an electrical conducting material. Examples of the electrical conducting material include metal powder of gold, silver, copper, etc., and inorganic fine particles such as carbon black, titanium oxide, and zinc oxide.

EXAMPLE

The invention will be explained more specifically with reference to the following Examples and Comparative examples.

Toner Fabrication

Example 1

At a first-stage mixing step, there was prepared 36 kg of a toner raw material which contains, at the following blending ratio, 100 parts by weight of polyester (binder resin), 6.1 parts by weight of colorant (C.I. pigment blue 15:3), and 1.2 parts by weight of a charge control agent, i.e. an organic boron compound (LR-147 manufactured by Japan Carlit Co., Ltd.), and these constituent components of the toner raw material were mixed by using a Henschel Mixer (trade name: FM mixer manufactured by Mitsui Mining Co., Ltd.) for seven minutes. Subsequently, at a second-stage mixing step, 25 parts by weight of a fine toner which had been removed in another toner manufacturing process, was put in 100 parts by weight of a raw material mixture obtained as above, and mixed for one minute by using the Henschel Mixer again. At a kneading step, a mixture obtained at the second-stage mixing step was then kneaded by using a twin-screw extruder (trade name: PCM65 manufactured by Ikegai Co., Ltd.) and cooled down to a room temperature, thereafter being coarsely pulverized by a cutter mill (trade name: VM-16 manufactured by Orient Co., Ltd.) at a pulverizing step. Next, a thus-obtained mixture was finely pulverized by a fluidized bed jet mill (manufactured by Hosokawa Micron Co.) and then classified at a classifying step by a rotation-type air-flow classifier (manufactured by Hosokawa Micron Co.). A toner was thus obtained of which volume average particle diameter was 6.7 μm. A rotational speed of a rotor in the fluidized bed jet mill was set at 3800 rpm, and a rotational speed of a rotor in the rotation-type air-flow classifier was set at 3930 rpm. An amount of pulverized materials supplied to the rotation-type air-flow classifier was set at 36 kg/h, and an air flow to the rotation-type air-flow classifier was set at 16.8 $Nm^3$/min. Note that "N" given in a unit of the air flow represents a standard state of gas (1 atm and 0° C.).

Example 2

A toner was fabricated in the same manner as Example 1 except that an added amount of the charge control agent was 0.8 part by weight.

Example 3

A toner was fabricated in the same manner as Example 1 except that an added amount of the charge control agent was 2.5 parts by weight.

Example 4

A toner was fabricated in the same manner as Example 1 except that a rotational speed of the rotor in the fluidized bed jet mill was set at 4500 rpm; a rotational speed of the rotor in the rotation-type air-flow classifier was set at 3950 rpm; an amount of pulverized materials supplied to the rotation-type air-flow classifier was set at 36 kg/h; and an air flow to the rotation-type air-flow classifier was set at 16.8 $Nm^3$/min.

Example 5

A toner was fabricated in the same manner as Example 1 except that a rotational speed of the rotor in the fluidized bed jet mill was set at 3300 rpm; a rotational speed of the rotor in the rotation-type air-flow classifier was set at 3950 rpm; an amount of pulverized materials supplied to the rotation-type air-flow classifier was set at 36 kg/h; and an air flow to the rotation-type air-flow classifier was set at 16.8 $Nm^3$/min.

Example 6

A toner was fabricated in the same manner as Example 1 except that a rotational speed of the rotor in the fluidized bed jet mill was set at 4800 rpm; a rotational speed of the rotor in the rotation-type air-flow classifier was set at 3950 rpm; an amount of pulverized materials supplied to the rotation-type air-flow classifier was set at 36 kg/h; and an air flow to the rotation-type air-flow classifier was set at 16.8 $Nm^3$/min.

Example 7

A toner was fabricated in the same manner as Example 1 except that a rotational speed of the rotor in the fluidized bed jet mill was set at 3700 rpm; a rotational speed of the rotor in the rotation-type air-flow classifier was set at 3950 rpm; an amount of pulverized materials supplied to the rotation-type air-flow classifier was set at 36 kg/h; and an air flow to the rotation-type air-flow classifier was set at 16.8 $Nm^3$/min.

Example 8

A toner was fabricated in the same manner as Example 1 except that an added amount of the colorant was 3.4 parts by weight.

Example 9

A toner was fabricated in the same manner as Example 1 except that an added amount of the colorant was 7.6 parts by weight.

Example 10

A toner was fabricated in the same manner as Example 1 except that an added amount of the colorant was 2.5 parts by weight.

Example 11

A toner was fabricated in the same manner as Example 1 except that an added amount of the colorant was 8.8 parts by weight.

Example 12

A toner was fabricated in the same manner as Example 1 except that all toner components and 25 parts by weight of the fine toner were mixed simultaneously at the first-stage mixing step and thus no second-stage mixing step exists.

Comparative examples will be explained hereinbelow to give comparison with the toner of the invention as fabricated in the above Examples.

Comparative Example 1

A toner was fabricated in the same manner as Example 1 except that an added amount of the charge control agent was 0.6 part by weight. A toner thus obtained was different from Examples 1-12 in that a surface CCA concentration per specific surface area of toner was smaller than a lower limit of the range of the invention, that is, $2.1\times10^{-6}$ g/$cm^2$ to $5.5\times10^{-6}$ g/cm$^2$ and in that a surface CCA concentration was smaller than a lower limit of the invention, that is, $1.8\times10^{-3}$ g/g.

Comparative Example 2

A toner was fabricated in the same manner as Example 1 except that an added amount of the charge control agent was 3.4 parts by weight. A toner thus obtained was different from Examples 1-12 in that a surface CCA concentration per specific surface area of toner exceeded an upper limit of the range of the invention, that is, $2.1\times10^{-6}$ g/cm$^2$ to $5.5\times10^{-6}$ g/cm$^2$.

[Fabrication of Two-Component Developer]

To 100 parts by weight of toner fabricated in each of Examples 1 to 12 and Comparative examples 1 and 2 was added 1.0 part by weight of negatively-charged hydrophobic silica (of which volume average particle diameter was 10 nm). A mixture thus obtained was mixed for five minutes by Henschel Mixer, resulting in an external additive material of the toner of the invention. Furthermore, 5 parts by weight of the obtained external additive material of the toner of the invention and 95 parts by weight of ferrite carrier (of which volume average particle diameter was 45 μm) were mixed for twenty minutes by a V-type mixer (trade name: V-5 manufactured by Tokuju Kosakusho Co., Ltd.), resulting in the two-component developers containing toners of Examples 1 to 12 and Comparative Examples 1 and 2.

[Evaluation Method]

The following evaluation methods were employed to respectively evaluate the surface CCA concentration per specific surface area, surface CCA concentration, particle distribution, background fog, charge amount, and comprehensive evaluation of toner.

(Surface CCA Concentration Per Specific Surface Area And Surface CCA Concentration)

The surface CCA concentration per specific surface area of toner indicates an amount of charge control agent exposed on a surface of toner per specific surface area of toner. Further, the surface CCA concentration indicates an amount of charge control agent exposed on a surface of toner per 1 g of toner.

(A) Calculation of Specific Surface Area of Toner

On the basis of surface area and volume of toner particles in respective particle diameter channels, entire surface area and entire volume of the total toner particles were obtained. Assuming that an appearance density is about 1 g/cm$^3$, the specific surface area (cm$^2$/g) of toner was calculated.

(B) Determination of Charge Control Agent

First, a sample for measurement was prepared to be used in determination of the charge control agent exposed on a surface of toner. Into a 2 wt %-triton solution was put 2.0 g of toner, and a mixture thus obtained was agitated by a spatula and furthermore agitated for five minutes by a stirrer. A solution thus obtained was filtered and its residue was then dried for about one day. And then, fluorescent X-ray measurement was employed to obtain fluorescent X-ray detection intensity of potassium atom which constitutes the charge control agent derived from the invention (trade name: ZSX Primus II manufactured by Rigaku Corporation). Next, the intensity thus obtained was compared with fluorescent X-ray intensity of untreated material, and an obtained difference therebetween was defined as an amount of elution.

(C) Calculation of Surface CCA Concentration

The surface CCA concentration (g/g) can be practically quantified by using a relational expression obtained based on the fluorescent X-ray detection intensity and an analytical curve regarding the amount of charge control agent, and the amount of elution obtained in (B).

(D) Calculation of Surface CCA Concentration Per Specific Surface Area of Toner

The surface CCA concentration per specific surface area of toner can be obtained from the above (A), (B), and (C) in accordance with the following formula (2).

$$\text{Surface CCA concentration per specific surface area of toner(g/cm}^2\text{)}=[\text{Surface CCA concentration(g/g)/Specific surface area of toner(cm}^2\text{/g)}] \quad (2)$$

(Particle Distribution)

First, a sample for measurement was prepared to be used in measuring a particle size of toner particle. Into a 100 ml beaker was put 20 ml of 1 wt %-(primary) sodium chloride solution. To the solution were subsequently added 0.5 mg of alkylbenzene sulfonic acid (which acts as a dispersant and which has an alkyl group ($C_nH_{2n+1}$, n=10 to 14)) and 3 mg of toner, followed by ultrasound dispersion for five minutes. To a mixture thus obtained was added 1 wt %-(primary) sodium chloride solution so that the total amount reached 100 ml, followed by ultrasound dispersion for another five minutes. The sample for measurement was thus obtained. Using Coulter Counter TA-III (manufactured by Coulter, Inc.), the sample was analyzed under the following condition: the aperture diameter was 100 μm, and the size of the particles to be analyzed ranged from 2 μm to 40 μm based on the number thereof. A result obtained by the above analysis was used in the calculation for obtaining numerical values to define the invention.

(Background Fog and Charge Amount)

The background fog and the charge amount were evaluated as follows.

A commercially-available copier (trade name: ARC150 manufactured by Sharp Corporation) having a two-component full-color developing device was filled up with a two-component developer. Using such a copier, initial and 5%-print images were copied on 20,000 sheets at an ordinary-temperature and ordinary-humid circumstance, followed by measurement of the background fog and the charge amount. Furthermore, to 100 parts by weight of the two-component developer which remained after making 20,000 copies, was supplied 1 part by weight of toner which had left for one day at a high-temperature and high-humid circumstance (35° C./85% RH), followed by measurement of the background fog and the charge amount. Note that the supplied toner was the same one as the toner contained in the two-component developer which had replenished the copier in the beginning.

In order to analyze the background fog, a transparent tape (a mending tape manufactured by Sumitomo 3M Limited) was attached to a non-image part on the photoreceptor, and the light-transmitting tape was then attached to a blank sheet, followed by the measurement of the density through X-rite 938 (manufactured by Nihon Heiban Insatsu Kizai Co., Ltd.). Further, only the transparent tape had been attached to a blank sheet in advance, and a density thereof was also measured. A difference between the densities measured as above was defined as a background fog value. The difference less than 0.015 was evaluated as "Very good"; the difference of 0.015 or more and less than 0.025 was evaluated as "Good; the difference of 0.025 or more and less than 0.035 was evaluated as "Poor"; and the difference of 0.035 or more was evaluated as "Bad".

A two-component developer taken off from a magnet roller by blow of air was analyzed by a suction-type small charge amount meter (trade name: 210HS-2A manufactured by Trek Incorporated) to measure the charge amount. The charge amount was measured at the initial stage, after 20,000 copies had been made, and after the toner supply following 20,000 copies. The charge amount was evaluated based on the change rate of the charge amount after 20,000 copies had been made, to the initial charge amount, and the change rate of the charge amount after the toner supply following 20,000 copies, to the charge amount after 20,000 copies. The change rate less than 5% was evaluated as "Very good"; the change rate of 5% or more and less than 10% was evaluated as "Good"; the change rate of 10% or more and less than 20% was evaluated as "Poor"; and the change rate of 20% or more was evaluated as "Bad".

An initial change rate (%) indicates a percentage of absolute value of difference between the initial charge amount and the charge amount after 20,000 copies had been made, to the initial charge amount. A post-toner-supply change rate (%) indicates a percentage of absolute value of difference between the charge amount after 20,000 copies had been made and the charge amount after the toner supply following 20,000 copies, to the charge amount after 20,000 copies.

(Comprehensive Evaluation)

The comprehensive evaluation was made as follows.

Good: "Good" and "Very good" are given to the majority or more of the above evaluation items. The developer is thus excellent and contained in the invention.

Poor: "Poor" are given to the majority or more of the above evaluation items. The developer is contained in the invention.

Bad: "Bad" is/are given to one or more of the above evaluation items. The developer is inferior to a conventional developer.

The following table 1 shows the amount of colorant, the number of mixing steps, the amount of charge control agent, the surface CCA concentration per specific surface area of toner, the surface CCA concentration, and the particle distribution in Examples 1 to 12 and Comparative examples 1 and 2.

TABLE 1

| | Colorant (Part by weight) | Number of Mixing step — | Charge control agent (Part by weight) | Surface CCA concentration per specific surface area of toner g/cm$^2$ | Surface CCA concentration g/g | Particle distribution $D_{50v}$ μm | % by number of 5 μm or less diameter-particle | $(D_{10v} - D_{90v})/D_{10v}$ |
|---|---|---|---|---|---|---|---|---|
| Ex. 1 | 6.1 | 2 | 1.2 | 2.10E−06 | 1.89E−03 | 6.8 | 23.0 | 0.446 |
| Ex. 2 | 6.1 | 2 | 0.8 | 3.20E−06 | 2.88E−03 | 6.6 | 26.0 | 0.445 |
| Ex. 3 | 6.1 | 2 | 2.5 | 5.50E−06 | 4.94E−03 | 6.8 | 18.5 | 0.443 |
| Ex. 4 | 6.1 | 2 | 1.2 | 4.30E−06 | 3.86E−03 | 5.6 | 33.9 | 0.417 |
| Ex. 5 | 6.1 | 2 | 1.2 | 4.60E−06 | 4.13E−03 | 7.5 | 16.7 | 0.418 |
| Ex. 6 | 6.1 | 2 | 1.2 | 4.20E−06 | 3.77E−03 | 4.8 | 50.3 | 0.268 |
| Ex. 7 | 6.1 | 2 | 1.2 | 4.80E−06 | 4.31E−03 | 8.4 | 16.4 | 0.473 |
| Ex. 8 | 3.4 | 2 | 1.2 | 3.50E−06 | 3.15E−03 | 6.9 | 17.8 | 0.418 |
| Ex. 9 | 7.6 | 2 | 1.2 | 4.20E−06 | 3.77E−03 | 6.3 | 31.1 | 0.472 |
| Ex. 10 | 2.5 | 2 | 1.2 | 2.80E−06 | 2.52E−03 | 7.4 | 17.3 | 0.422 |
| Ex. 11 | 8.8 | 2 | 1.2 | 3.10E−06 | 2.79E−03 | 7.1 | 18.4 | 0.432 |
| Ex. 12 | 6.1 | 1 | 1.2 | 4.20E−06 | 3.77E−03 | 7.0 | 20.9 | 0.418 |
| Com. Ex. 1 | 6.1 | 2 | 0.6 | 1.20E−06 | 1.08E−03 | 6.8 | 19.0 | 0.443 |
| Com. Ex. 2 | 6.1 | 2 | 3.4 | 5.60E−06 | 5.03E−03 | 6.6 | 25.4 | 0.445 |

The following table 2 and table 3 show the evaluation results of the background fog and the charge amount at the initial stage, after 20,000 copies had been made, and after the toner supply following 20,000 copies, in the cases of using the two-component developer containing toner of Examples 1 to 12 and Comparative examples 1 and 2.

TABLE 2

| | At initial stage | | After 20,000 copies | | | After toner supply following 20,000 copies | | |
|---|---|---|---|---|---|---|---|---|
| | Background fog | Charge amount μC/g | Background fog | Charge amount μC/g | Initial change rate % | Background fog | Charge amount μC/g | Post-toner-supply change rate % |
| Ex. 1 | 0.008 | −25.1 | 0.016 | −23.1 | 8.0 | 0.028 | −19.8 | 19.6 |
| Ex. 2 | 0.006 | −22.6 | 0.015 | −21.9 | 3.1 | 0.021 | −19.2 | 12.3 |
| Ex. 3 | 0.010 | −24.2 | 0.018 | −23.1 | 4.5 | 0.031 | −20.3 | 12.1 |
| Ex. 4 | 0.007 | −22.6 | 0.026 | −18.7 | 17.3 | 0.021 | −17.3 | 7.5 |
| Ex. 5 | 0.012 | −23.8 | 0.016 | −20.9 | 12.2 | 0.030 | −18.6 | 11.0 |
| Ex. 6 | 0.012 | −26.1 | 0.014 | −23.8 | 8.8 | 0.030 | −22.1 | 7.1 |
| Ex. 7 | 0.009 | −19.8 | 0.013 | −18.2 | 8.1 | 0.023 | −16.2 | 11.0 |
| Ex. 8 | 0.012 | −22.8 | 0.031 | −18.5 | 18.9 | 0.021 | −17.0 | 8.1 |
| Ex. 9 | 0.012 | −26.8 | 0.014 | −25.9 | 3.4 | 0.023 | −25.1 | 3.1 |
| Ex. 10 | 0.012 | −25.6 | 0.022 | −21.7 | 15.2 | 0.030 | −18.3 | 15.7 |
| Ex. 11 | 0.015 | −21.0 | 0.019 | −19.1 | 9.0 | 0.030 | −16.4 | 14.1 |
| Ex. 12 | 0.012 | −16.8 | 0.028 | −14.5 | 13.7 | 0.030 | −12.3 | 15.2 |
| Com. Ex. 1 | 0.007 | −19.2 | 0.016 | −17.8 | 7.3 | 0.048 | −12.1 | 32.0 |
| Com. Ex. 2 | 0.010 | −26.1 | 0.037 | −14.8 | 43.3 | 0.038 | −11.9 | 19.6 |

TABLE 3

| | At initial stage | After 20,000 copies | | After toner supply following 20,000 copies | | Comprehensive |
|---|---|---|---|---|---|---|
| | Background fog | Background fog | Charge amount | Background fog | Charge amount | Evaluation |
| Ex. 1 | Very good | Good | Good | Poor | Poor | Good |
| Ex. 2 | Very good | Good | Very good | Good | Poor | Good |
| Ex. 3 | Very good | Good | Very good | Poor | Poor | Good |
| Ex. 4 | Very good | Poor | Poor | Good | Good | Good |
| Ex. 5 | Very good | Good | Poor | Poor | Poor | Poor |
| Ex. 6 | Very good | Very good | Good | Poor | Good | Good |
| Ex. 7 | Very good | Very good | Good | Good | Poor | Good |
| Ex. 8 | Very good | Poor | Poor | Good | Good | Good |
| Ex. 9 | Very good | Very good | Very good | Good | Very good | Good |
| Ex. 10 | Very good | Good | Poor | Poor | Poor | Poor |
| Ex. 11 | Good | Good | Good | Poor | Poor | Good |
| Ex. 12 | Very good | Poor | Poor | Poor | Poor | Poor |
| Com. Ex. 1 | Very good | Good | Good | Bad | Bad | Bad |
| Com. Ex. 1 | Very good | Bad | Bad | Bad | Bad | Bad |

The results shown in FIG. 2 and FIG. 3 indicate that the toners of Examples 1 to 12 according to the invention were excellent in temporal stability and environmental stability of charges as described later when compared to the toners of Comparative examples 1 and 2 since the toners of Examples 1 to 12 each contain an organic boron compound as a charge control agent, with the surface CCA concentration per specific surface area of toner falling in a range from $2.1\times10^{-6}$ g/cm$^2$ to $5.5\times10^{-6}$ g/cm$^2$ and the surface CCA concentration of $1.8\times10^{-3}$ g/g or more.

The toners of Examples 1 to 12 according to the invention which were excellent in temporal stability and environmental stability of charges, exhibited a favorable result that all evaluation items have "poor" or higher ranks for the background fog and charge amount at the initial stage, after 20,000 copies had been made, and after the toner supply following 20,000 copies as shown in Table 2 and Table 3. That is to say, the charge amount was stable and moreover, the number of occurrence of the background fog was small, even upon a long-term printing occasion. Further, it was clear that even when the toner was left at a high-temperature and high-humid circumstance, the charge amount of the toner was not very influenced by moisture, and when replenishing the image forming apparatus with the toner, the toner was sufficiently charged, and the number of occurrences of the background fog was small.

The toner of Example 10 was recognized as available enough from the comprehensive evaluation, but the amount of colorant contained therein was small, i.e., 2.5%, which leads a larger content of resin component. As a result, the resistance was increased during a long-term use, and the toner was thus evaluated as "Poor" for the charge amount after 20,000 copies had been made and for the background fog and charge amount after the toner supply following 20,000 copies.

Further, the toner of Example 12 was recognized as available enough from the comprehensive evaluation, but the dispersibility of the charge control agent into the toner deteriorates because the respective toner components and fine toner were mixed simultaneously at the first-stage mixing step, resulting in evaluation of "Poor" for all the evaluation items of the background fog and charge amount after 20,000 copies had been made and after the toner supply following 20,000 copies.

In the meantime, the toner of Comparative example 1 was low in the surface CCA concentration and thus small in the amount of the charge control agent dropping off from the surfaces of toner particles, resulting in favorable temporal stability of charges. The toner did not, however, have the function as the charge control agent due to the surface CCA concentration per specific surface area of toner which was smaller than $2.1\times10^{-6}$ g/cm$^2$, thus resulting in poor start-up characteristic which caused the charge amount to fluctuate in a wide range at a high-temperature and high-humid circumstance. And the toner was evaluated as "Bad" for the background fog and charge amount after the toner supply following 20,000 copies.

Further, the toner of Comparative example 2 was high in the surface CCA concentration per specific surface area of toner and thus large in the amount of the charge control agent dropping off from the surfaces of toner particles, resulting in a lack of the temporal stability of charges upon a long-term printing occasion. In this case, the charge amount measured after 20,000 copies had been made was lower than that measured at the initial stage, thus causing the background fog to remarkably arise. Furthermore, the charge amount also largely fluctuates at a high-temperature and high-humid circumstance and therefore, the result obtained after the toner supply following 20,000 copies was not favorable.

In view of the foregoing, as collective evaluation of the result obtained by comparison among Examples 1 to 12 and Comparative examples 1 and 2 according to the invention, in order to satisfy the temporal stability and environmental stability of charges, there are required: the use of the organic boron compound as the charge control agent; the surface CCA concentration per specific surface area of toner falling in a range from $2.1\times10^{-6}$ g/cm$^2$ to $5.5\times10^{-6}$ g/cm$^2$; and the surface CCA concentration of $1.8\times10^{-3}$ g/g or more.

Note that although C.I. Pigment Blue 15:3 for cyan is used as colorant in Examples, the colorant can be replaced with various colorants cited hereinabove and used in the same manner as that of Examples.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner, comprising at least:

binder resin;

colorant; and an organic boron compound acting as a charge control agent, the toner of which surface CCA (charge control agent) concentration per specific surface area of toner falls in a range from $2.1\times10^{-6}$ g/cm$^2$ to $5.5\times10^{-6}$ g/cm$^2$ and of which surface CCA concentration is $1.8\times10^{-3}$ g/g or more, wherein the following formula $D_{10v}$ and $D_{90v}$ satisfy the following formula (1) where $D_{10v}$ represents a particle diameter at 10% of cumulative volume counted from a large-diameter side in a cumulative volume distribution, and $D_{90v}$ represents a particle diameter at 90% of cumulative volume counted from the large-diameter side in the cumulative volume distribution:

$$0.415 \leqq (D_{10v}-D_{90v})/D_{10v} \leqq 0.475 \quad (1),$$

wherein $D_{50v}$ falls in a range of 5 μm to 8 μm where $D_{50v}$ represents a particle diameter at 50% of cumulative volume counted from the large-diameter side in the cumulative volume distribution, and wherein a content of toner particles each having a diameter of 5 μm or less is 15% by number to 35% by number.

2. The toner of claim 1, wherein a content of the colorant is 3 parts by weight to 10 parts by weight based on 100 parts by weight of the binder resin.

* * * * *